US007934904B2

(12) United States Patent
Demiraydin et al.

(10) Patent No.: US 7,934,904 B2
(45) Date of Patent: May 3, 2011

(54) DIFFUSER AND EXHAUST SYSTEM FOR TURBINE

(75) Inventors: Lale Demiraydin, Zurich (CH); Ralf Greim, Birmenstorf (CH)

(73) Assignee: Alstom Technology Ltd., Baden (CH)

( * ) Notice: Subject to any disclaimer, the term of this patent is extended or adjusted under 35 U.S.C. 154(b) by 53 days.

(21) Appl. No.: 12/463,203

(22) Filed: May 8, 2009

(65) Prior Publication Data

US 2009/0263241 A1 Oct. 22, 2009

Related U.S. Application Data

(63) Continuation of application No. PCT/EP2007/060821, filed on Oct. 11, 2007.

(30) Foreign Application Priority Data

Nov. 13, 2006 (EP) ..... 06123940

(51) Int. Cl.
*F01D 25/30* (2006.01)

(52) U.S. Cl. ..... 415/207; 415/224.5; 415/225

(58) Field of Classification Search ..... 415/914, 415/211.2, 220, 213.1, 214.1, 207, 176–178, 415/224.5, 225, 226; 60/690, 692, 694, 697
See application file for complete search history.

(56) References Cited

U.S. PATENT DOCUMENTS

| | | | | |
|---|---|---|---|---|
| 3,149,470 | A * | 9/1964 | Herzog | 60/697 |
| 4,391,566 | A * | 7/1983 | Takamura | 415/211.2 |
| 5,257,906 | A * | 11/1993 | Gray et al. | 415/226 |
| 5,494,405 | A * | 2/1996 | Gray et al. | 415/211.2 |
| 5,518,366 | A * | 5/1996 | Gray | 415/226 |
| 6,231,304 | B1 * | 5/2001 | Andersson | 415/211.2 |
| 6,419,448 | B1 * | 7/2002 | Owczarek | 415/207 |
| 2002/0174655 | A1 | 11/2002 | Tarelin et al. | |

FOREIGN PATENT DOCUMENTS

JP 2005233154 A 9/2005

* cited by examiner

*Primary Examiner* — Igor Kershteyn
(74) *Attorney, Agent, or Firm* — Volpe and Koenig P.C.

(57) ABSTRACT

A diffuser and exhaust system is provided for a turbine having an axial-radial diffuser and an exhaust hood including diffuser inner and outer flow guides that extend from an inlet to an outlet. The exhaust hood includes two throats or flow passages between the diffuser outlet and an exhaust hood side wall. The outer flow guide includes a recess, at one of the said two flow passages. The flow passage is positioned in relation to a point in the exhaust hood in the direction of the tangential flow velocity vector, where the point in the exhaust hood is farthest away from the exhaust hood outlet. The recess prevents a re-acceleration of the flow within the exhaust hood and affects an increase in the performance of the diffuser and exhaust hood system.

11 Claims, 4 Drawing Sheets

DIFFUSER AND EXHAUST SYSTEM FOR TURBINE

CROSS REFERENCE TO RELATED APPLICATIONS

This application is a continuation of International Application No. PCT/EP2007/060821 filed Oct. 11, 2007, which claims priority to European Patent Application No. 06123940.6, filed Nov. 13, 2006, the contents of both of which are incorporated by reference as if fully set forth.

FIELD OF INVENTION

The invention pertains to an axial-radial diffuser and an exhaust system for a turbine, in particular a steam turbine.

BACKGROUND

In a turbine with an axial-radial diffuser the working fluid is discharged following the last row of turbine blades and flows into an annularly flared flow passage, the diffuser, formed by an inner and an outer flow guide extending from the hub or tip of the last blade row of the turbine, respectively. The diffuser extends initially in the axial direction and circumferentially over the full 360° around the turbine rotary axis and then bends radially outwards with respect to the turbine rotary axis. The diffuser outlet typically leads to an exhaust hood, where typically the outlet is positioned within the exhaust hood. The exhaust hood in turn has an outlet to discharge the working fluid. In the case of a steam turbine, the outlet leads steam into a condenser. The exhaust hood has opposite its outlet a first portion with typically a semi-circular cross-section that encompasses half of the turbine and diffuser and a second portion with rectangular cross-section that extends from the first portion to the outlet of the exhaust hood. The transition from the first portion to the second portion of the exhaust hood is formed by two so-called throats, which are opposite from each other with respect to the turbine. The outlet is frequently arranged below the level of the turbine axis, which is frequently referred to as a downward discharging exhaust hood. However, it can also be arranged at the same level, or above the level of the turbine axis. A condenser would then be arranged adjacent on either side of the turbine or above the turbine, respectively.

The steam exiting a steam turbine after the last blade row diffuses, or decelerates, in the diffuser. As the kinetic energy of the steam flow is thus decreased in the diffuser, the static pressure rises correspondingly from the last row of turbine blades to the diffuser exit. With this increase of steam pressure in the flow direction in the diffuser there is a corresponding decrease in steam pressure at the level of the last turbine blade row as the pressure at the exhaust hood outlet is given by the cooling environment (for example the condenser) applied. Consequently, the turbine work output is increased compared to that of a turbine without a diffuser. Therefore, the pressure increase within the diffuser and the turbine power output can potentially be improved by an appropriate diffuser design.

Increasing the static pressure within the diffuser can optimize the performance of a turbine. However, losses can occur due to flow separation and vortex formations within the hood, which compromise the overall performance. Such vortices may develop to different degrees in different regions of a diffuser and exhaust hood, e.g. due to support struts or depending on the orientation of the exhaust hood. For example, in a diffuser, which leads the steam into a downward discharging exhaust hood (exhaust hood outlet below the level of the turbine), the steam diffusing in the lowest portion of the diffuser passage will enter the exhaust hood with no or very little change in flow direction. However, the steam diffusing in the uppermost portion of the diffuser and essentially being directed in the radial and vertically upward direction, experiences a change in flow direction of 180° in order to flow downwards into the exhaust hood and towards the outlet at the bottom. Such large changes in direction cause vortices and losses, which adversely affect the performance of the diffuser and consequently also the power output of the turbine.

U.S. Pat. No. 5,518,366 discloses a diffuser for a turbo machine having an inner and outer flow guide each beginning at an inlet adjacent to the last blade row of the turbine and ending at an outlet within an exhaust hood. The downward discharging exhaust hood has a flow-guiding surface that has a distance from the inlet of the outer diffuser flow guide that varies over the circumference and has a minimum of less than the length of the last turbine blade at a particular location, for example at the top of the exhaust hood. The outer flow guide has an axial length from its inlet to its outlet that also varies over the circumference of the flow guide and has a minimum at the location where the minimum distance between the flow-guiding surface of the exhaust hood and the inlet of the outer flow guide occurs. The minimum distance between the flow-guiding surface of the exhaust hood and the inlet of the outer diffuser flow guide and the axial length of the outer flow guide are defined in relation to the length of the airfoil of the last turbine blade row.

SUMMARY

The present disclosure is directed to a diffuser and exhaust system for a turbine having an axial-radial diffuser and an exhaust hood. The diffuser and exhaust system include an inner flow guide and an outer flow guide, each extending from a diffuser inlet at a last turbine blade row to a diffuser outlet. The inner flow guide extends from a hub at the last turbine blade row and the outer flow guide extends from a turbine casing at the last blade row. The diffuser outlet extends from an end portion of the inner flow guide to an end portion of the outer flow guide and the exhaust hood includes a first portion having an end wall and a side wall extending around approximately half the circumference of the diffuser outlet and a second portion extending from the first portion to an exhaust hood outlet. The exhaust hood includes two flow passages at transition points from the first portion to the second portion of the exhaust hood and between the diffuser outlet and the exhaust hood side wall. The outer flow guide includes a lip at the diffuser outlet that is rotationally symmetric over a first segment of an outer flow guide circumference and includes a recess over a second segment of the circumference. An angular extent of the second segment of the circumference includes an angular position of one of the two flow passages, and the second segment extends over an angular range of up to 140°.

DETAILED DESCRIPTION OF THE PREFERRED EMBODIMENTS

Introduction to the Embodiments

Figure 1:
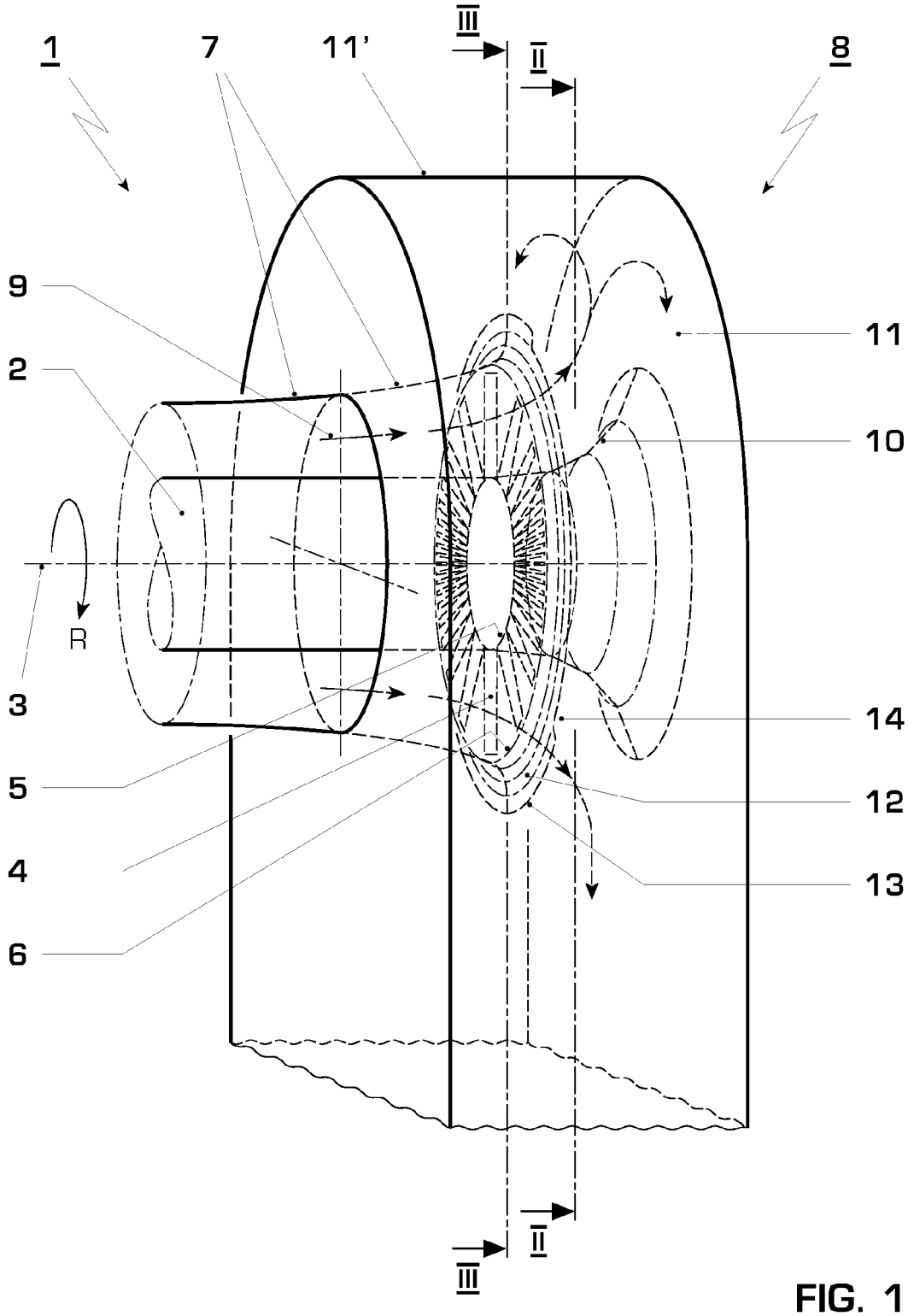
FIG. 1 shows a view of an embodiment of the turbine diffuser and exhaust system according to the disclosure.

A diffuser and exhaust system comprises a diffuser and an exhaust hood, the diffuser having an inner and outer flow guide forming flow passage from an inlet at the last turbine blade row to an outlet positioned within the exhaust hood. The inner flow guide extends from the hub of the last turbine blade row to the diffuser outlet, while the outer flow guide extends from the turbine casing at the tip of the last blade row to the diffuser outlet. The diffuser is an axial-radial diffuser, which extends first in the axial direction with respect to the turbine rotary axis and then bends in the radially outward direction. The exhaust hood comprises a first portion having and en wall and a sidewall extending around approximately one half of the circumference of the diffuser outlet. It further comprises a second portion that extends from the first portion to a discharge outlet. The exhaust hood comprises two throats or flow passages between the diffuser outlet and the sidewall of the exhaust hood. They are positioned at the point of transition from the first portion to the second portion of the exhaust hood, at circumferentially opposite sides of the turbine.

The outer flow guide comprises a lip at the diffuser outlet that is rotationally symmetric over a first segment of the circumference and comprises a recess or cutout over a second segment of the circumference. The extent of the second segment of the circumference includes the angular position of one of the two throats. The particular throat is positioned in the direction of the tangential flow velocity vector in relation to a particular point in the exhaust hood. This point in the exhaust hood is circumferentially opposite of the exhaust hood outlet and the point that is farthest away from the exhaust hood outlet.

The tangential flow velocity component is the component of the absolute flow velocity vector leaving the last stage of the turbine. The direction of the tangential flow velocity vector depends on the design of the last turbine blade row. In many turbines, this direction coincides with the direction of the turbine rotation. In other turbine designs however, the direction of the tangential flow velocity vector is in the direction opposite the turbine rotation.

For example, in a turbine there is a tangential flow velocity vector in the direction of the turbine rotation, where this direction is the clockwise direction. If the turbine is equipped with a downward discharging exhaust hood, the point circumferentially opposite the exhaust hood outlet is at the top of the hood. The recess at the outer diffuser flow guide is then positioned at the throat on the right hand side of the exhaust hood when viewing the exhaust hood from its inlet.

The recess or cutout on the lip of the outer flow guide is placed at only one of the two throats or flow passages from the first portion to the second portion of the exhaust hood. About this particular throat, where the recess is acting, there is typically a high-speed flow area, at which the tangential flow velocity vector tends to push the working fluid predominantly. It is therefore the area that is most critical in terms of re-acceleration and static pressure decrease. The particular placement of the recess at this throat effects an enlargement and prevents a re-acceleration of the working fluid in the throat area. A rise in kinetic energy and decrease in static pressure is therefore prevented and the performance of the diffuser and exhaust system is improved.

In a first exemplary embodiment of the invention, the angular range of the second segment of the outer flow guide circumference includes the position of said throat, where the angular range of the recess extends in both rotational directions an angular range up to 140°, i.e. towards as well away from the exhaust hood outlet. It includes therewith a high-speed flow area having vortices that extend in both directions from the throat. In a preferred exemplary embodiment of the invention, the angular extent of second segment lies in a range up to 90°.

In a second exemplary embodiment of the invention, the angular range of the recess extends from the position of said throat in the direction of the tangential flow velocity vector, where the angular extent lies in a range up to 90°.

In both first and second exemplary embodiments, the angular range of the recess at its greatest extent, reaches as far as the center of the outlet of the exhaust hood. Such range includes the largest extent of the high-speed flow area in the exhaust hood.

In the first and second exemplary embodiments of the invention, the diffuser profile is the same over the entire circumference of the diffuser that is in both the first and second segments of the diffuser.

In a further exemplary embodiment of the invention, the meridional cross-sectional profile of the flow guide in the first portion of the circumference differs from the profile in the second portion of the circumference. The recess on the lip of a flow guide gives rise to a relatively abrupt transition, which can cause a diminished diffuser performance. In order to compensate for this loss of performance, the profile of the flow guide in the angular range of the recess, i.e. of the second segment of the circumference is altered compared to the profile over the rest of the circumference, i.e. in the first segment of the circumference. Between the two segments there is a smooth geometrical transition. This measure, in particular, avoids losses associated with flow separation and vortices.

In an exemplary embodiment, the profile in the first segment having a recess has an overall curvature that is smaller compared to the curvature of the profile in the second segment outside the recess area.

DETAILED DESCRIPTION

FIG. 1 shows an exhaust system 1 for a turbine having a turbine rotor 2 with turbine rotary axis 3 rotating in a direction as indicated by the arrow. Of the turbine blades only the last blade row is shown, arranged on the rotor 2 with blades 4 extending from the hub 5 to the blade tips 6. An inner turbine casing 7 encloses the turbine channel up to the tips of the last blade row. The turbine exhaust system includes an axial-radial diffuser and an exhaust hood 8, where the diffuser provides a flow passage for the turbine working fluid 9 from the turbine last blade row into the exhaust hood 8. The exhaust hood 8 is in this case a downward discharging exhaust hood having an outlet (not shown) below the level of the turbine. It comprises an end wall 11 and a sidewall 11' that extends around approximately one half of the diffuser outlet's circumference. The working fluid 9 entering the exhaust hood flows toward the exhaust hood outlet, where at the topmost space within the hood the fluid abruptly changes its flow direction and in the lowermost space of the hood the fluid undergoes the least change in flow direction.

Figure 4:
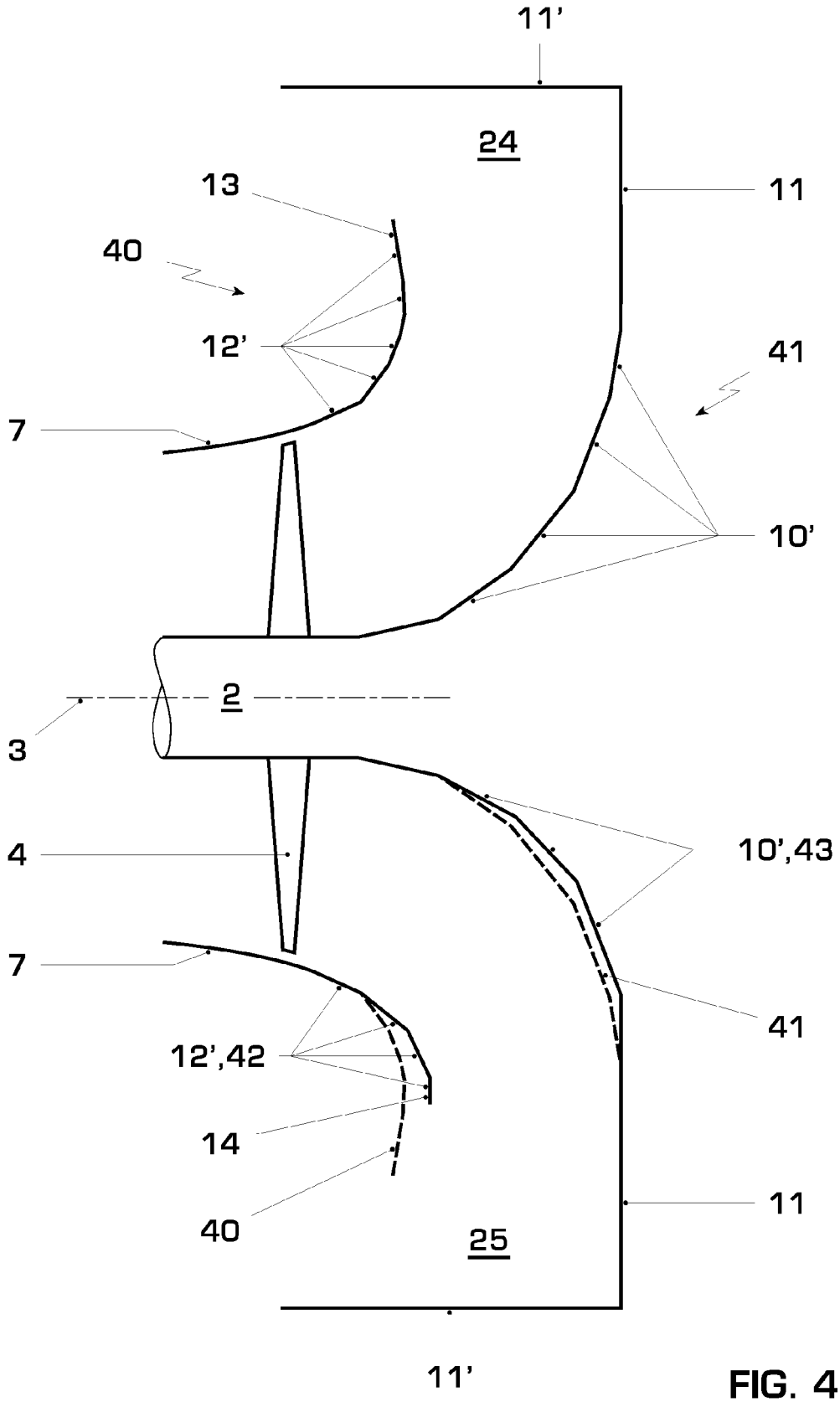
FIG. 4 shows a meridional cross-section taken at lines IV-IV in FIG. 3 of the outer flow guide of a particular embodiment of the diffuser according to the disclosure.

The diffuser comprises an inner flow guide 10 extending from the hub 5 first in the axial direction with respect to the turbine rotary axis 3, then bending radially outward and ending at the end wall 11 of the exhaust hood 8. A diffuser outer flow guide 12 extends from the end of the inner casing 7 first in the axial direction, bending in the radial outward direction and ending within the exhaust hood 8. The diffuser guides the working fluid 9 into the exhaust hood, where it flows downward. In the example shown, the inner and outer flow guides 10 and 12 are configured of several straight edged individual flow passage sections 10' and 12', which are joined at kink angles to each other (FIG. 4). The outer flow guide 12 has a lip 13 at its end, which has a recess or cutout 14 over an angular range that reduces the length of the outer flow guide. In the embodiment shown, the recess has a depth equal to the straight edged section at the end of the outer flow guide. In a further embodiment, the depth includes more than one section.

In a further embodiment, the inner or outer flow guide or both flow guides are realized in one smoothly shaped piece (without kink angles in its profile). In this case, the depth of the recess is arbitrary.

Figure 2:
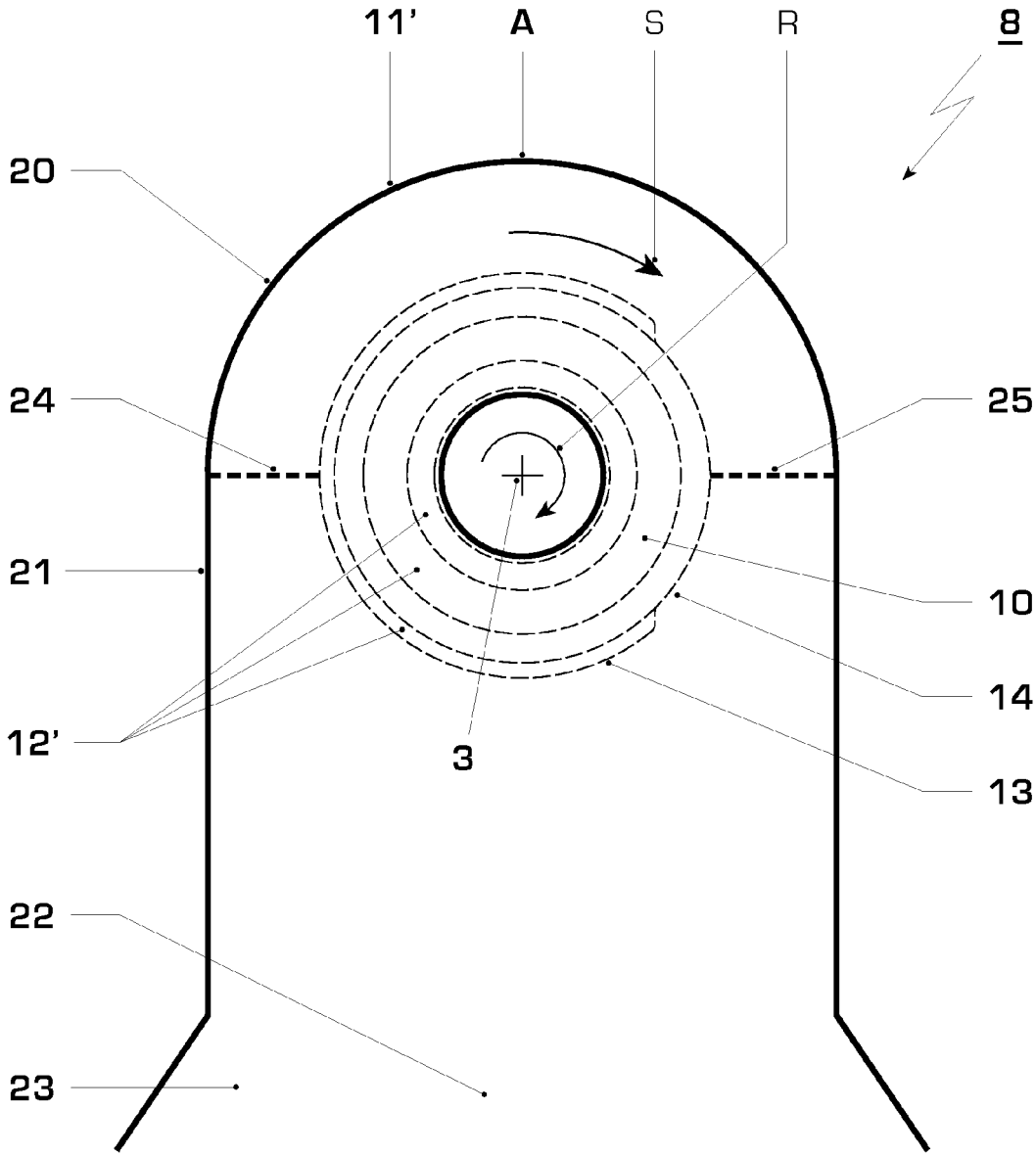
FIG. 2 shows a cross-section of the exhaust hood taken along the line II-II in FIG. 1.

FIG. 2 shows the cross-section of a downward discharging exhaust hood 8 through the sidewall 11' and the diffuser outlet between the outer and inner flow guides. It shows a first portion 20 of the hood, in this case the upper portion, having an approximately semi-circular shape and the second portion 21 extending from the first portion downward toward the exhaust hood outlet 22. In the case of a steam turbine system, the exhaust hood outlet 22 leads into a condenser neck 23. The exhaust system of this type can also be arranged sideways, where the exhaust hood outlet is on either side of the turbine. The exhaust hood outlet can also be positioned at the top, above the level of the turbine. These types of exhaust systems are referred as sideways or upwards discharging systems. All geometric features of the diffuser and exhaust hood as described herein are in sideways or upward exhaust systems rotated accordingly.

The transition or passage from the first to the second portion of the exhaust hood is referred as the throat of the exhaust hood. In the exhaust hood shown, the throats or flow passages 24 and 25 from the first to the second portion of the exhaust hood are on either side of the turbine at the level of the turbine rotary axis 3. Depending on the design and placement of the first portion of the exhaust hood with respect to the turbine rotary axis 3, the throats are on either side of the turbine and either at, above or below the level of the turbine rotary axis. In the throats 24, 25, the working fluid experiences flow acceleration, which affects high-speed flow areas in an exhaust system of this type. The degree of re-acceleration of the working fluid flow however is not the same in both throats on either side of the turbine. The re-acceleration is greater on one side depending on the direction of the tangential flow velocity vector S in the fluid flow, wherein most turbine designs the direction of the tangential flow velocity vector S corresponds to the direction of the turbine rotation R. The throat with the greater re-acceleration of fluid flow is, for most turbine designs, in the throat 25, which is positioned, in relation to the point A, in the direction of the tangential flow velocity vector S. Point A is farthest away from the exhaust hood outlet 22. According to the disclosure, the outer flow guide 12 has at its lip 13 a recess 14 that includes the angular position of throat or flow passage 25 and extends over a given angle away from the throat 25. The angular extent of the recess 14 includes the high-speed flow area within the exhaust hood.

Figure 3A:
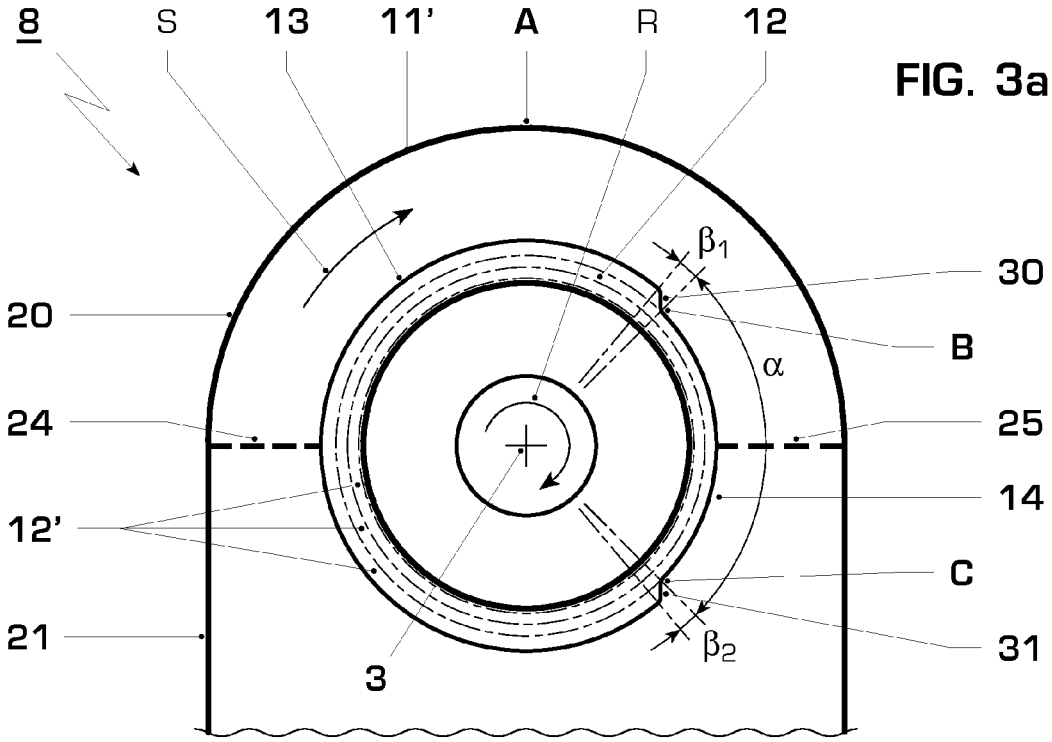
FIGS. 3*a* and *b* show a cross-section taken at lines III-III in FIG. 1 of the exhaust hood and diffuser outer flow guide according to the disclosure as viewed in the direction of working fluid flow. They each show an exemplary embodiment of the outer flow guide with different angular extents of the recess or cutout.

FIG. 3*a* shows a first variant of the diffuser and exhaust system for a turbine having rotary axis 3 and rotating in the direction indicated by the arrow (clock-wise direction). The exhaust hood has two throats 24 and 25 forming the passage for the working fluid between the outermost edge of the outer flow guide 12 and the sidewall of the exhaust hood at the transition point from the first portion 20 to the second portion 21 of the exhaust hood. Typically, throat 25 is the more critical throat with respect to the performance of the diffuser. (In turbine designs with tangential flow velocity vectors in a direction opposite the turbine rotary direction, the critical throat would be throat 24.) The outer diffuser flow guide 12 is placed within the exhaust hood 8 and comprises, for example, several sections 12', which are arranged at a kink angle to each other. The section 12' at the end of the flow guide 12 has a lip 13 and is rotationally symmetric over a first angular segment C-B of the flow guide extending from point B in the clockwise direction to point C. In a second angular segment B-C of the circumference, the section 12' of the flow guide has a recess 14 extending from Point B in the clockwise direction to point C over an angular range $\alpha$, which includes the angular position of flow passage or throat 25. The area of the recess 14 reaches for example about 45° in both rotational directions from the level of the throat 25. The depth of the recess 14 is, for example, equal to the depth of the outermost flow guide section 12'. In order to prevent flow separation or vortices about the points of transition to the recess 14, the transition is realized by curved portions 30 and 31 extending over angles $\beta_1$ and $\beta_2$.

Figure 3B:
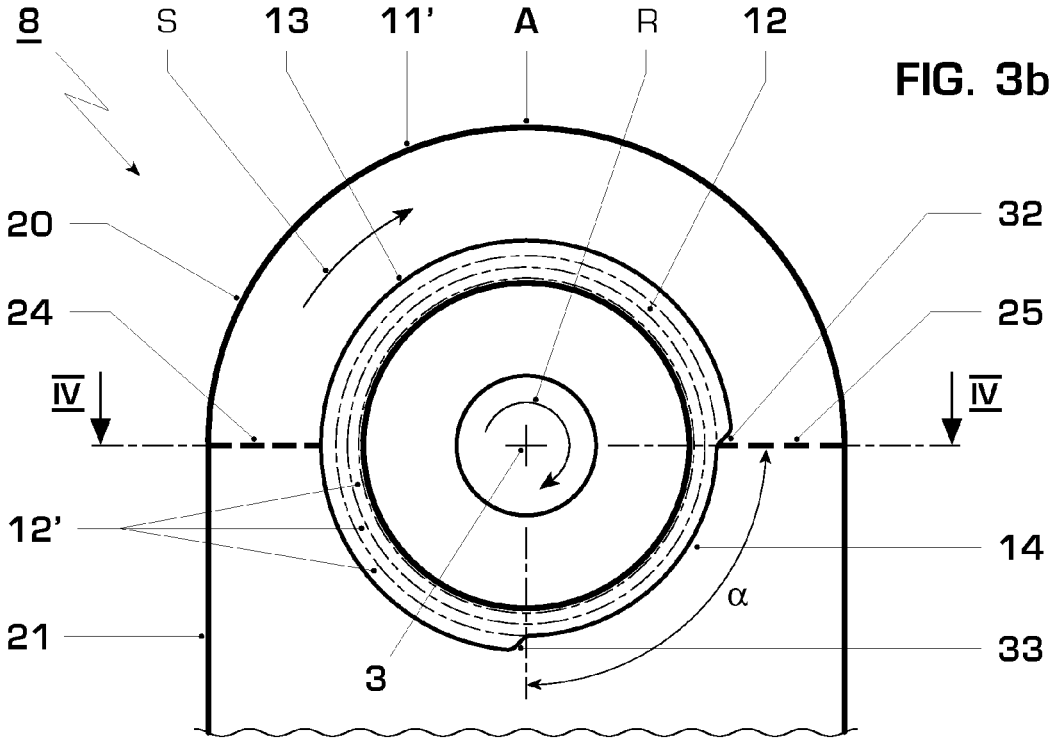

FIG. 3*b* shows another variation of the diffuser and exhaust system similar to that of FIG. 3*a* in all essential aspects of the invention. In this variant, the recess area includes again the angular position of the throat 25. The recess 14 of the section 12' at the end of the flow guide extends from the position of the throat 25 in the clockwise direction over the angle a as far as the center of the exhaust hood outlet 22. This area includes all the high-speed flow area that may occur in exhaust systems of this type. Similar to the diffuser in FIG. 3*a*, the recess has curved transition portions 32 and 33.

The profile of the outer flow guide 12 as well as of the inner flow guide 10 in FIGS. 1-3 is identical over its entire circumference. In a further embodiment of the invention, the profile varies over the circumference as shown in connection with FIG. 4.

FIG. 4 shows a top view of a cross-section of the outer and inner flow guides 12 and 10 with flow guide sections 12' and 10', respectively. The profiles 40 and 41 of the outer and inner flow guides respectively lead to the diffuser outlet and throat 24. The profiles 42 and 43 of the outer and inner flow guides respectively lead to the diffuser outlet and to the throat 25.

The outer flow guide profile 40 extends to the lip 13. The outer flow guide profile 42 leading to the throat 25 is shortened by the depth of the recess 14 in comparison to the outer flow guide profile 40 leading to the throat 24. In the particular embodiment shown in this figure, the profile 42 differs from the profile 40 not only with regard to the recess 14, but also in the shape of the profile itself from the inlet at the last turbine blade row 4 of the diffuser up to the outlet of the diffuser. In order to illustrate the difference between the profiles, the profile 40 is shown in broken lines next to the profile 42. The profile 42 differs from the profile 40 in that its overall curvature of the profile 42 is smaller than that for profile 40. This measure avoids flow separation, which may occur otherwise due to the shorter profile of the outer flow guide.

The inner flow guide 10 with sections 10' and profile 41 leads from the diffuser inlet to the end wall 11 of the exhaust hood and to the throat 24. The inner flow guide 10 with sections 10' and profile 43 leads from the diffuser inlet to the end wall 11 of the exhaust hood and to the throat 25. Profile 41 differs from profile 43, again in that the overall curvature of the profile 41 is greater than the curvature of profile 43. In order to illustrate the difference, broken lines next to the profile 43 indicate the profile 41.

The transition from profile 40 to profile 42 is realized by suitable geometrically smooth curves.

TERMS USED IN FIGURES

1 diffuser and exhaust system
2 rotor
3 turbine rotary axis
4 turbine blades
5 hub
6 blade tips
7 turbine casing
8 exhaust hood
9 working fluid flow direction
10 inner flow guide
11 end wall of the exhaust hood
11' sidewall of the exhaust hood
12 outer flow guide
13 lip of the outer flow guide
14 recess or cutout from the lip 13 of the outer flow guide 12
15-19 - - -
20 first (upper) portion of exhaust hood
21 second (lower) portion of the exhaust hood
22 outlet of exhaust hood
23 condenser neck
24 throat
25 throat
30-33 curved transition portions to the recess 14
R direction of rotation of the turbine rotor
S direction of tangential flow velocity vector (typical in the direction of turbine rotation; however can also be in direction opposite the turbine rotation)
A point farthest away from exhaust hood outlet
B, C points delimiting angular extent of recess 14 in outer flow guide 12
$\alpha$ angle of recess 14
$\beta_1$, $\beta_2$ angular extent of transition portion into recess 14
40 profile of outer flow guide leading to throat 24
41 profile of inner flow guide leading to throat 24
42 profile of outer flow guide leading to throat 25
43 profile of inner flow guide leading to throat 25

The invention claimed is:

1. Diffuser and exhaust system (1) for a turbine having an axial-radial diffuser and an exhaust hood (8), the diffuser and exhaust system comprising an inner flow guide (10) and an outer flow guide (12), each extending from a diffuser inlet at a last turbine blade row (4) to a diffuser outlet, the inner flow guide (10) extending from a hub (5) at the last turbine blade row (4) and the outer flow guide (12) extending from a turbine casing (7) at the last blade row (4), and the diffuser outlet extending from an end portion of the inner flow guide to an end portion of the outer flow guide (12), and the exhaust hood (8) comprising a first portion (20) including an end wall (11) and a side wall (11') extending around approximately half the circumference of the diffuser outlet and a second portion (21) extending from the first portion (20) to an exhaust hood outlet (22), the exhaust hood (8) comprising two flow passages (24, 25) at transition points from the first portion (20) to the second portion (21) of the exhaust hood (8) and between the diffuser outlet and the exhaust hood side wall (11'), the outer flow guide (12) comprising a lip (13) at the diffuser outlet that is rotationally symmetric over a first segment (C-B) of an outer flow guide circumference and comprising a recess (14) over a second segment (B-C, $\alpha$) of the circumference, where an angular extent of the second segment ($\alpha$) of the circumference includes an angular position of one of the two flow passages (24, 25), and the second segment (B-C, $\alpha$) extends over an angular range ($\alpha$) of up to 140°.

2. Diffuser and exhaust system (1) according to claim 1, wherein the angular extent of the second segment ($\alpha$) of the outer flow guide circumference includes the flow passage (25) positioned closest to and in a direction of a turbine rotation from a point (A) in the exhaust hood (8), where said point (A) in the exhaust hood (8) is farthest away from the exhaust hood outlet (22).

3. Diffuser and exhaust system (1) according to claim 1, wherein the angular extent of the second segment ($\alpha$) of the outer flow guide circumference includes the flow passage (24) positioned closest to and in a direction opposite a turbine rotation from a point (A) in the exhaust hood (8), where said point (A) in the exhaust hood (8) is farthest away from the exhaust hood outlet (22).

4. Diffuser and exhaust system (1) according to claim 2, wherein said second segment (B-C, $\alpha$) extends over an angular range ($\alpha$) of up to 90°.

5. Diffuser and exhaust system (1) according to claim 4, wherein said second segment (B-C, $\alpha$) extends from one of the flow passages (24, 25) to a center of the outlet of the exhaust hood (8).

6. Diffuser and exhaust system (1) according to claim 3, wherein said second segment (B-C, $\alpha$) extends from said one flow passage (24, 25) in both rotational directions.

7. Diffuser and exhaust system (1) according to claim 1, wherein a meridional cross-sectional profile (40) of the outer flow guide (12) in the first segment (C-B) of the circumference differs from a meridional cross-sectional profile (42) in the second segment (B-C) of the circumference of the outer flow guide (12).

8. Diffuser and exhaust system (1) according to claim 7, wherein the meridional cross-sectional profile (41) of the inner flow guide (10) in the first segment of the circumference differs from the meridional cross-sectional profile (43) in the second segment of the circumference of the inner flow guide (10).

9. Diffuser and exhaust system (1) according to claim 8, wherein the outer flow guide has a profile in the segment having the recess having a curvature that is smaller compared to the curvature of the profile of the outer flow guide in the segment having no recess.

10. Diffuser and exhaust system (1) according to claim 8, wherein the inner flow guide (10') has a profile (43) in a segment leading to the throat (25) where the outer flow guide (12') has a recess (14), said profile (43) having a curvature that is greater compared to the curvature of the profile (41) of the inner flow guide (10') in a segment leading to a throat (24) where the outer flow guide (12') has no recess.

11. Diffuser and exhaust system (1) according to claim 1, wherein the turbine is a steam turbine.

* * * * *